US006135850A

United States Patent [19]

Reed

[11] Patent Number: 6,135,850

[45] Date of Patent: Oct. 24, 2000

[54] LIGHTED TOY AND SAFETY METHOD

[76] Inventor: Gerald D. Reed, 14501 Berkshire, Independence, Mo. 64055

[21] Appl. No.: 09/201,209

[22] Filed: Nov. 30, 1998

Related U.S. Application Data

[60] Provisional application No. 60/068,982, Dec. 29, 1997.

[51] Int. Cl.[7] ..... A63H 29/22

[52] U.S. Cl. ..... 446/484; 446/485; 446/486; 411/368; 362/158; 362/189

[58] Field of Search ..... 446/484, 485, 446/486, 470; 411/368; 273/237; 362/158, 189

[56] References Cited

U.S. PATENT DOCUMENTS

| | | | |
|---|---|---|---|
| 2,020,484 | 11/1935 | Turner | 473/570 |
| 3,011,048 | 11/1961 | O'Brien | 473/570 |
| 3,304,651 | 2/1967 | Deyerl | 473/570 |
| 4,701,146 | 10/1987 | Swenson | 473/570 |
| 4,827,655 | 5/1989 | Reed | 43/17.5 |
| 5,138,537 | 8/1992 | Wang | 362/187 |
| 5,236,383 | 8/1993 | Connelly | 446/219 |
| 5,375,839 | 12/1994 | Pagani | 473/570 |
| 5,392,203 | 2/1995 | Harris, Jr. | 362/186 |
| 5,496,142 | 3/1996 | Fodor | 411/544 |
| 5,888,156 | 3/1999 | Cmiel | 473/570 |

*Primary Examiner*—Sam Rimell
*Assistant Examiner*—Bena B. Miller
*Attorney, Agent, or Firm*—Charles M. Kaplan

[57] ABSTRACT

A safety method and toy position a rotatable stopper in a bore where the stopper can not be gripped by human hands and create a friction fit between the stopper and bore that requires a rotational torque that can not be applied to the stopper by human hands alone when the stopper is in the bore.

15 Claims, 2 Drawing Sheets

LIGHTED TOY AND SAFETY METHOD

This application is entitled to the filing date of U.S. Provisional Application Ser. No. 60/068,982, which was filed on Dec. 29, 1997.

BACKGROUND OF THE INVENTION

This invention relates to toys, and more particularly to lighted floating toys that can be used by young children in a bath tub or swimming pool. Small toys that emit light require the use of small batteries to provide the energy that produces the light. The small batteries are a hazard to young children who may put them in their mouth and swallow them. Prior art light emitting devices can often be opened easily by young children and their batteries can thus be easily removed. Also, toys used by children in a bath tub should not have sharp, rough or protruding surfaces that can scratch or otherwise injure the children.

OBJECTIVES OF THE INVENTION

Accordingly, it is an object of this invention to provide improved lighted aquatic toys for children.

Another object is to provide children's toys with a safety lock and methods that will prevent young children from opening the toy and removing hazardous components.

An additional object is to provide toys with a safety lock that can not be opened by human hands alone.

A further object is to provide safe, smooth surfaced floating lighted toys that are durable, economical, pleasing in appearance, easy to use and maintain, and methods that make access to dangerous components in such toys childproof, and which do not possess defects found in similar prior art toys and safety methods.

Other objects and advantages of toys and methods incorporating this invention will be found in the specification and claims and the scope of the invention will be set forth in the claims.

DESCRIPTION OF THE INVENTION

Figure 1:
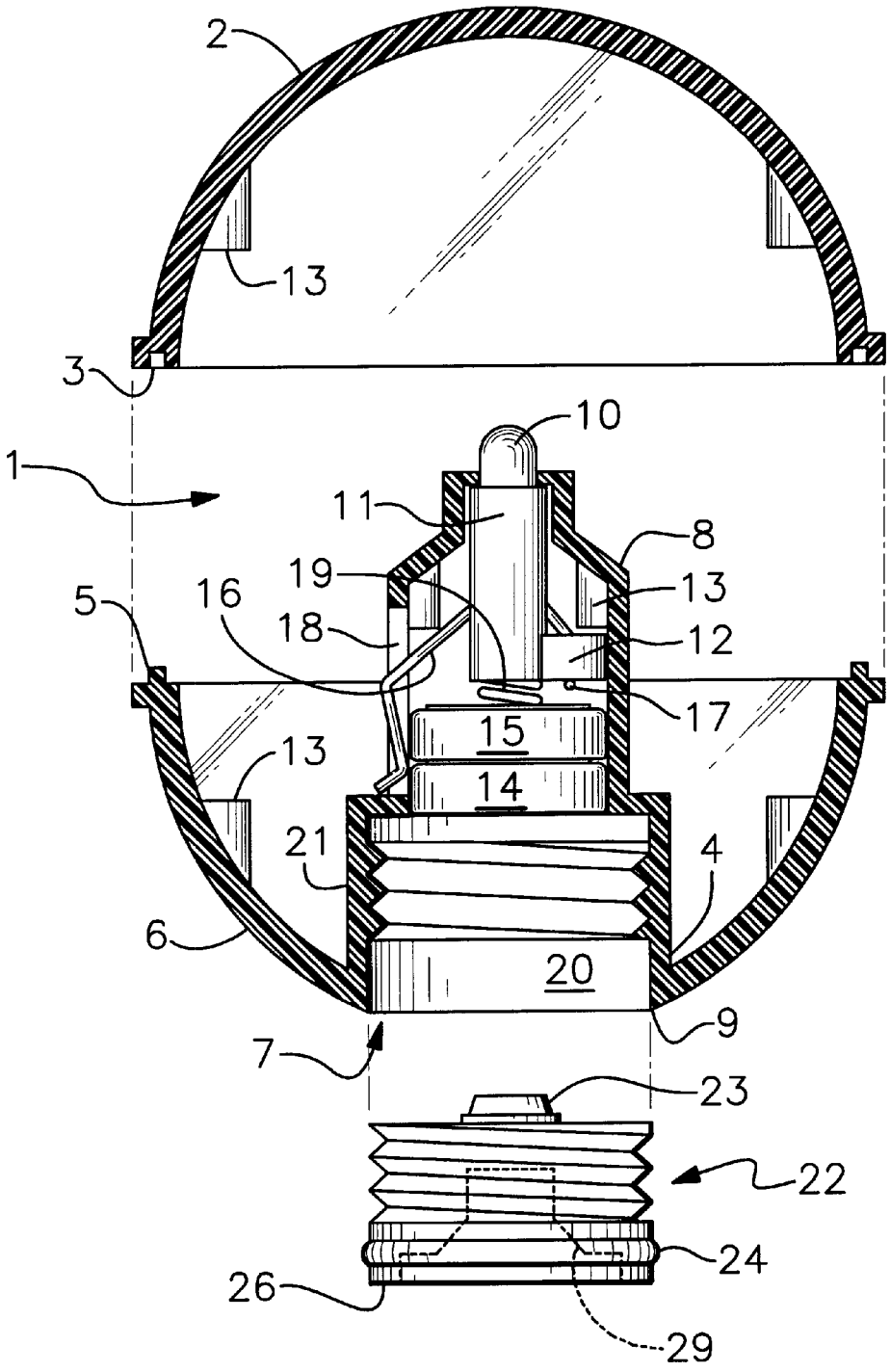
FIG. 1 is an enlarged exploded partially cross sectional side view of an embodiment of the invention.
Figure 2:
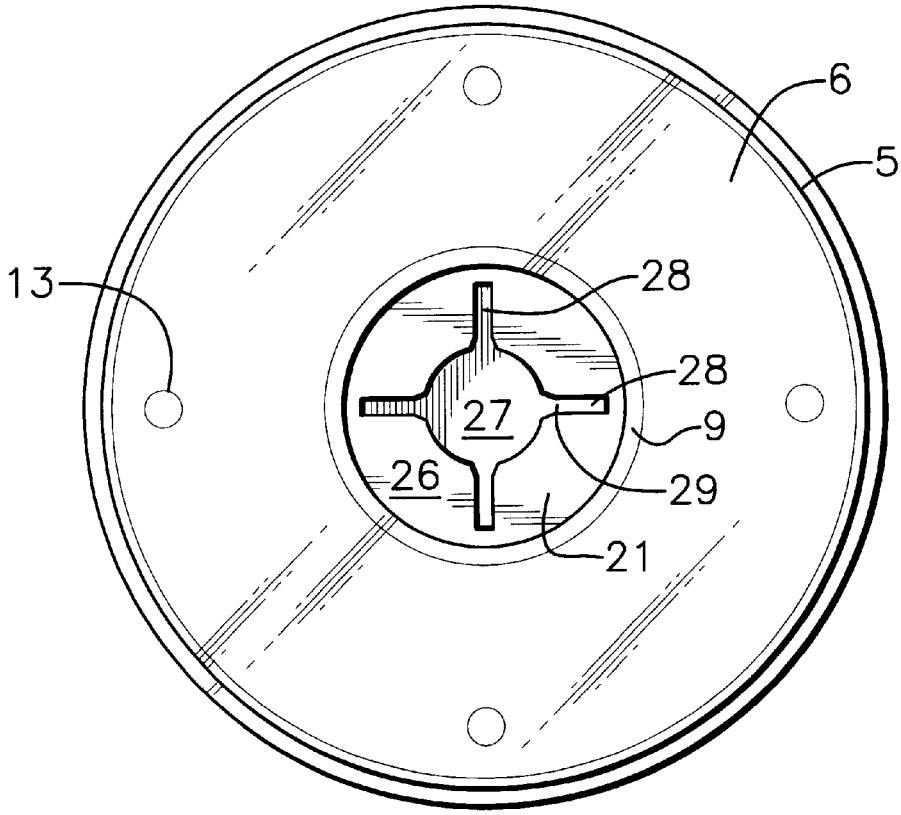
FIG. 2 is a bottom view of the embodiment shown in FIG. 1.
Figure 3:
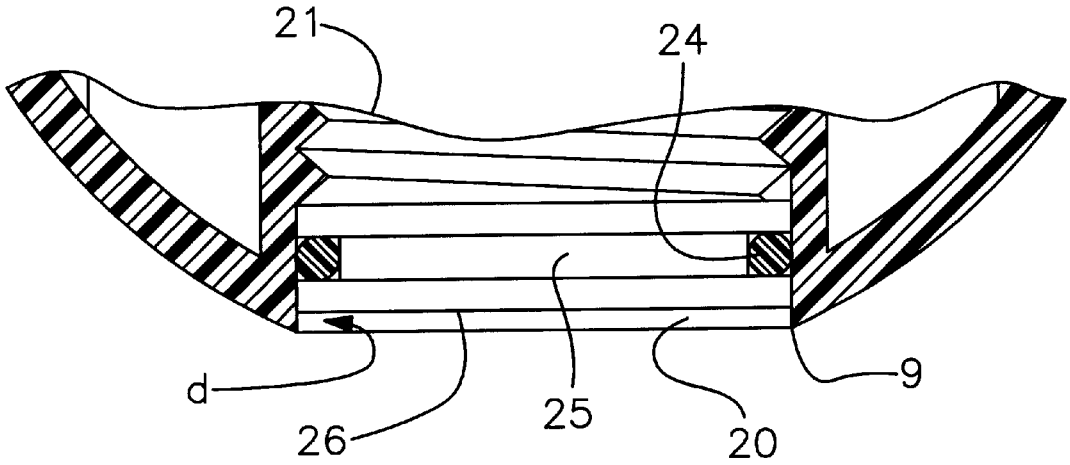
FIG. 3 is a partially cross sectional fragmentary view of the embodiment shown in FIG. 1.

The drawing shows a smooth surfaced, tranparent, lighted, plastic, floating, essentially spherical bath tub toy 1 in accord with this invention. A hollow top shell 2 has a circular circumferential edge 3 that is ultrasonically welded in a water tight seal to a corresponding circumferential edge 5 of a mating bottom shell 6. The bottom shell 6 has a circular central opening 7 that provides access to the interior of a generally cylindrical support housing 8 on the inside of the toy. The shells 2 and 6 may be made from a transparent plastic such as polycarbonate. The open end 4 of housing 8 is integral with shell 6 at opening 7. A flat exterior edge surface 9 surrounds the opening 7. The flat surface 9 facilitates storage of the toy when it is not in use by preventing the toy from rolling when it is resting on the flat surface 9. A conventional light emitting diode 10 is mounted by the press fit in the housing 8 of its holder 11 that includes an integral support projection 12. Ribs 13 may be attached to the shells 2 and 6 and housing 8 for strength and to aid in ejection of the shells from molds in which they are cast. Two small circular removable energy cells 14 and 15, such as Energizer A 76 batteries, may be included in means for activating the diode. The cells 14 and 15 are dangerous to young children in that the cells are small enough to be easily swallowed.

The diode activating means also includes wire conductors 16 and 17 which connect the diode 10 to the positive and negative terminals of the energy cells. Conductor 16 fits into a slot 18 in housing 8 and is shaped so that it can contact only the positive side of cell 14. Conductor 17 passes through projection 12 and is formed to extend toward the center of the toy where it will can be contacted by the negative terminal of cell 15. A small coil spring 19 has one end attached to holder 11, and its other end contacts the cell 15 for preventing the cell from contacting conductor 17 and activating the diode when the toy is not being used. The support structure for the diode, batteries and conductors is essentially the same as disclosed for the same components in my U.S. Pat. No. 4,827,655.

Central opening 7 has a smooth cylindrical entrance orifice 20 that leads to a threaded bore 21. A generally circular stopper 22 has threads mating with those in bore 21. The light emitting diode 10 is activated by movement of the cells 14 and 15 through the tubular housing 8 into contact with conductors 16 and 17. Movement of the cells is caused by screwing stopper 22 into central opening 7. Rotation of the stopper axially advances the stopper until a projection 23 at its inner end contacts the bottom end of cell 14. Continued rotation of stopper 22 in the same direction pushes the cells against the bias of spring 19 into contact with the conductors 16 and 17. Rotation of the stopper in the opposite direction allows spring 19 to push the cells out of contact with conductor 17, thus breaking the flow of current to the diode 10. A resilient plastic or rubber O-ring 24 in a groove 25 adjacent the outer terminal end 26 of stopper 22 ensures a water tight seal.

Means including stopper 22 and O-ring 24 are provided for preventing removal of the stopper with human hands alone. Stopper 22 is thus a safety lock that can prevent access by young children to the interior of the toy where the cells 14 and 15 are located. A relatively tight friction fit is created between the O-ring 24 and the orifice 20; there is also frictional engagement between the threads on the stopper and those in the opening 7. The outer terminal end 26 of the stopper is located inside of the orifice 20 and will be spaced from the flat edge 9 by a distance d of at least one to two millimeters, both when the stopper is essentially fully advanced so that the diode is emitting light and when the stopper has been retracted until the diode is not activated. When located in this position inside the of the orifice 20, the stopper 22 can not be gripped by human hands. The friction fit between the O-ring 24 and the orifice 20 and the friction of the threads should require at least about four pounds-inch of torque to rotate the stopper 22 to remove the stopper from the toy; preferably the required torque should be in the range of from about four to eleven pounds-inch. This rotation torque that is required to remove the stopper can not be achieved by human hands alone because the stopper 22 can not be gripped when the end 26 is spaced from edge 9 inside of orifice 20.

To facilitate advancing and retracting, the safety stopper 22 has a circular aperture 27 centered in its outer end. Perpendicular slots 28 intersect the aperture 27, and the bottom edges 29 of the slots slant toward the center of the stopper. This permits insertion of small objects like a tool or coin, such as a dime, into the stopper to provide enough leverage to rotate the stopper into or out of the toy.

In a commercial embodiment of the lighted toy 1, the O-ring 24 is a PRP 568 Universal Series 015 resilient rubber O-ring having an internal diameter of 0.551±0.007 inches and a width (i.e. thickness diameter) of 0.070±0.003 inches. The O-ring groove 25 has an outside diameter of 0.583±0.003 inches, and when the O-ring is stretched to fit into the groove 25 the O-ring width shrinks to approximately 0.062 inches; this gives the O-ring an effective outer diameter of approximately 0.707 inches. The interior diameter diameter of the entrance orifice 20 is 0.699±0.002 inches. This creates an interference fit between the O-ring 24 and the orifice 20 in the range of between 0.003 and 0.013 inches with an average value of 0.008 inches. The interference fit values are measures of the amount the O-ring 24 is compressed when it is in the orifice 20. This amount of interference fit creates the torques in the range of about four to eleven pounds-inch that are required to rotate the stopper 22 before the stopper can be removed from the toy 1. Thus the stopper 22 provides a safety lock that prevents young children from gaining access to the interior of the toy with their hands alone. This restricts removal of the energy cells 14 and 15 to persons capable of using a tool or other object that can be inserted into a slot 28 so as to provide enough leverage to produce the required rotational torque.

While the present invention has been described with reference to particular a embodiment of a lighted toy and safety method, it is not intended to illustrate or describe all of the equivalent forms or ramifications thereof. Also, the words used are words of description rather than limitation, and various changes may be made without departing from the spirit or scope of the invention disclosed herein. It is intended that the appended claim cover all such changes as fall within the true spirit and scope of the invention.

I claim:

1. A waterproof toy containing a component dangerous to children and means for activating a light on the inside thereof, comprising a hollow waterproof shell having a circular central opening, an internally threaded bore surrounding said central opening, a rotatable stopper for engaging the light activating means and turning said light off and on, removal of said stopper from said shell permitting access to said dangerous component inside of said toy, said stopper having external threads that mate with the threads in said bore, said shell having a smooth entrance orifice between its outside edge surface and said threaded bore, a resilient compressible O-ring in a groove in said stopper around said stopper adjacent an outer terminal end of said stopper, said O-ring being compressed into a frictional engagement with said smooth entrance orifice that is tight enough to prevent rotation of said stopper by human hands and removal of said stopper by human hands alone.

2. The waterproof toy defined in claim 1, further comprising said stopper having its outer terminal end located inside of said smooth entrance orifice and spaced from said outside edge surface of said shell when said stopper is in positions to turn said light off and to turn said light on, wherein said stopper can not be gripped by human hands when it is positions and can not be removed by human hands alone.

3. The waterproof toy defined in claim 2, wherein said tight frictional engagement between said O-ring and smooth entrance orifice requires a torque of at least about four pounds-inch to rotate said stopper.

4. The waterproof toy defined in claim 3, wherein said torque required to rotate said stopper is in the range from about four to eleven pounds-inch.

5. The waterproof toy defined in claim 1, wherein said light activating means includes an energy cell that is small enough to be swallowed by children, said energy cell being movable in said bore by rotation of said stopper.

6. The waterproof toy defined in claim 1, wherein rotation of said stopper requires that a torque of at least about four pounds-inch be applied to its outer terminal end.

7. The waterproof toy defined in claim 6, wherein said torque required to rotate said stopper is in the range from about four to eleven pounds-inch.

8. The waterproof toy defined in claim 1, further comprising said stopper having a slot in its outer terminal end for insertion of a small object to provide enough leverage to generate a torque required to rotate said stopper into and out of said toy.

9. A lightable waterproof toy comprising a hollow plastic shell having a circular central opening, an internally threaded bore surrounding said central opening, said shell having a smooth entrance orifice between its outside edge surface and said threaded bore, a removable energy cell small enough to be swallowed by children and means for activating a light on the inside of said shell, a rotatable stopper for engaging said energy cell so as to turn said light off and on, removal of said stopper from said shell permitting access to said energy cell, said stopper having external threads that mate with the threads in said bore, said stopper having its outer terminal end located inside of and surrounded by said smooth entrance orifice and spaced from said outside edge surface of said shell within said shell when said stopper is in positions to turn said light off and to turn said light on, wherein said stopper can not be gripped by human hands when it is in said positions and said stopper can not be removed by human hands alone, a resilient compressible O-ring surrounding said stopper in a groove in said stopper adjacent said outer terminal end of said stopper, said O-ring being compressed between said stopper and said smooth entrance orifice into a frictional engagement with said smooth entrance orifice that is tight enough to prevent rotation of said stopper by human hands alone.

10. The lightable waterproof toy defined in claim 9, wherein the tight frictional engagement between said O-ring and said smooth entrance orifice requires a torque of at least about four pounds-inch to rotate said stopper.

11. The lightable waterproof toy defined in claim 9, wherein said torque required to rotate said stopper is in the range from about four to eleven pounds-inch.

12. The lightable waterproof toy defined in claim 9, further comprising said stopper having a slot in its outer terminal end for insertion of a small object to provide enough leverage to generate a torque required to rotate said stopper into and out of said toy.

13. A method of preventing removal of a rotatable stopper having an outer terminal end from a toy having a smooth entrance orifice with an outside edge surface, said toy containing a component dangerous to children that can be accessed by rotation of said stopper within said smooth entrance orifice, comprising the steps of providing a rotatable stopper, rotating said stopper until its outer terminal end is within and surrounded by said smooth entrance orifice beyond said outside edge surface on the inside of said toy where said stopper can not be gripped and rotated by human hands and can not be removed from said toy by human hands alone, surrounding said stopper with a resilient compressible O-ring and compressing said O-ring within said smooth entrance orifice between said stopper and said smooth entrance orifice so as to create a friction fit between said stopper and said smooth entrance orifice that is sufficiently tight to prevent rotation of said stopper by human hands alone.

14. The method of preventing removal of a stopper from a toy defined in claim 13, wherein said friction fit is sufficiently tight to require a rotational force of at least about four pounds-inch to rotate said stopper.

15. The method of preventing removal of a stopper from a toy defined in claim 14, wherein said friction fit requires a rotational force of at least about four to eleven pounds-inch to rotate said stopper.

* * * * *